United States Patent [19]

Riordan et al.

[11] Patent Number: 4,909,301

[45] Date of Patent: Mar. 20, 1990

[54] METHOD OF MAKING A BEARING

[75] Inventors: Robert M. Riordan; William L. Wentland, both of Rockford, Ill.

[73] Assignee: Sundstrand Corporation, Rockford, Ill.

[21] Appl. No.: 258,013

[22] Filed: Oct. 14, 1988

[51] Int. Cl.[4] ..... B22D 19/00

[52] U.S. Cl. ..... 164/104; 164/98

[58] Field of Search ..... 164/98, 100, 103, 104, 164/105, 106

[56] References Cited

U.S. PATENT DOCUMENTS 2,881,490 4/1959 Benham ..... 164/103

FOREIGN PATENT DOCUMENTS 956141 9/1982 U.S.S.R. ..... 164/103

*Primary Examiner*—Kuang Y. Lin

*Attorney, Agent, or Firm*—Wood, Dalton, Phillips, Mason & Rowe

[57] ABSTRACT

A method of making a bearing composed of a bronze preform having aluminum or aluminum alloy cast thereabout. The method includes the step of placing the bronze preform in a mold so as to be supported at one end thereof. The bronze preform is formed of a bronze having lead with a determining melting point and boiling point. The method also includes the step of providing molten aluminum or aluminum alloy to be fed into the mold after the bronze preform has been placed therein. The molten aluminum or aluminum alloy is at a temperature between the melting point and boiling point of lead in the bronze of the bronze preform. The method further includes the step of feeding the molten aluminum or aluminum alloy into the mold under pressure after the bronze preform has been placed therein. The molten aluminum or aluminum alloy contacts the bronze preform and produces a molten lead during partial erosion of the surface thereof. In this manner, the molten aluminum or aluminum alloy forces the molten lead away from the surface of the bronze preform and is metallurgically bonded without an intervening lead band directly to the bronze preform.

25 Claims, 2 Drawing Sheets

METHOD OF MAKING A BEARING

The present application is a substitute application of U.S. Ser. No. 139,010, filed Dec. 29, 1987, now abandoned.

FIELD OF THE INVENTION

The present invention relates to a method of making a bearing and, more particularly, a bearing composed of a bronze preform having aluminum or aluminum alloy cast thereabout.

BACKGROUND OF THE INVENTION

In the past, the fabrication of bimetallic bearings has been plagued by the difficulty of obtaining a good bond between the dissimilar metals that make up the bearing. Conventional fabrication techniques call for a bearing metal piece to be placed in a form or mold and the dissimilar metal, in a molten state, to then be poured into and around the bearing metal piece. For many combinations of metals, this type of process has produced a bond of satisfactory quality.

Unfortunately, it has been observed that when the bearing metal piece is bronze and the dissimilar metal is molten aluminum, the bonding between the metals is of poor quality. It is believed that, when the molten aluminum comes in contact with the bronze, the lead which is present in the bronze is converted to a gaseous state. More specifically, the poor quality of the bonding between the metals is caused by the presence of molten lead, aluminum and liberated lead gas with no place to escape.

In other words, the molten lead and lead gas are present to an unacceptable degree in a band between the aluminum and bronze. This lead outgassing coupled with the inability of molten lead to escape from between the aluminum and bronze has made it necessary to abandon conventional fabrication techniques in favor of joining the bronze and aluminum components by soldering. However, when soldering has been utilized, it has proven to be expensive due in part to poor production yields. Soldered joints can also de-bond at some operating conditions.

Among the casting techniques that have been proposed, Monnot U.S. Pat. No. 929,778 discloses a film coating on an iron or steel object by dipping the iron or steel object in a bath of super molten copper. A further coating is then formed by contacting the surface defined by the film coating with a molten aluminum at substantially ordinary casting temperatures to create a layer of a desired thickness. In this manner, Monnot produces a compound metal body having a core or iron or steel, a copper film coating, and a layer of aluminum.

As for other bearing and casting methods, Jones et al U.S. Pat. No. 1,789,979 discloses lining a shell formed of steel by fluxing the shell with a solution of borax after which the shell is dipped into a mass ofmolten bearing metal such as babbitt. Whitfield et al U.S. Pat. No. 2,453,772 discloses coating articles having a copper base with an aluminum or aluminum alloy by first coating the copper surface with a thin skin or layer of a metal of the class consisting of nickel, iron, cobalt, manganese and chromium. Further, Niimi et al U.S. Pat. No. 3,841,386 discloses dipping a solid beryllium workpiece in a molten bath of copper after which the workpiece is quickly dipped in a molten bath of aluminum, set in a mold, and molten aluminum is poured into the mold to complete the casting.

Despite these and other efforts, it has remained to overcome the problems of successfully producing a bronze and aluminum bearing without the need for soldering. The present invention is directed to overcoming these problems and accomplishing the resulting objects by providing a unique new method of making a bearing.

SUMMARY OF THE INVENTION

Accordingly, the present invention is directed to a method of making a bearing composed of a bronze preform having aluminum or aluminum alloy cast thereabout. The method includes the step of placing the bronze preform in a mold so as to be supported at one end thereof. The bronze preform is formed of a bronze having lead with a predetermined melting point and boiling point. The method also includes the step of providing molten aluminum or aluminum alloy to be fed into the mold after the bronze preform has been placed therein. The molten aluminum or aluminum alloy is at a temperature between the melting point and the boiling point of lead in the bronze of the bronze preform. The method further includes the step of feeding the molten aluminum or aluminum alloy into the mold under pressure after the bronze preform has been placed therein. The molten aluminum or aluminum alloy contacts the bronze preform and produces a molten lead during partial erosion of the surface thereof. Moreover, the molten aluminum or aluminum alloy forces the molten lead away from the surface of the bronze preform and is metallurgically bonded without an intervening lead band directly to the bronze preform.

In a preferred embodiment, the molten aluminum or aluminum alloy is forced into the mold at the end opposite the end where the bronze preform is supported after placement therein. More specifically, the bronze preform is preferably supported in the mold at the top thereof and the molten aluminum or aluminum alloy is fed into the mold at the bottom thereof. Advantageously, the mold includes at least one catch basin adapted to receive the molten lead forced away from the surface of the bronze preform by the molten aluminum or aluminum alloy.

In one embodiment, the bronze preform is preimmersed and agitated in a bath of the molten aluminum or aluminum alloy prior to being placed in the mold to initiate alloying of the aluminum and the copper and to force the molten lead away from the surface thereof. In this connection, the bronze preferably has a lead content of over 15%, the lead has a melting point of approximately 621° F., and the molten aluminum or aluminum alloy is at a temperature of approximately 1400° F. In order to maximize the results, the bronze preform is preimmersed and agitated in the bath for at least approximately ten seconds and is thereafter removed from the bath and placed in the mold in no more than approximately 15 seconds.

In the preferred embodiment, the bronze preform comprises a generally cylindrical body portion having a radially extending rim at one end thereof adapted to cooperate with the top of the mold for supporting the bronze preform therein. It is also advantageous for the bronze preform to have a circumferentially chamfered edge at the other end thereof adapted to be disposed in spaced confronting relation to the bottom of the mold. In addition, the bronze preform preferably includes an axially extending threaded bore in the one end thereof adapted to releasably receive an insert handling fixture and a second, shallower axially extending bore in the one end thereof but of greater diameter than the threaded bore.

Still further, the mold preferably includes a plurality of circumferentially spaced catch basins disposed about the top of the mold in spaced relation to the surface of the bronze preform. It is also advantageous to provide seal means about the second axially extending bore in the bronze preform. When the fixture includes a plate cooperating with the radially extending rim and a lifting ring cooperating with the threaded bore, the seal means is utilized to prevent the molten aluminum or aluminum alloy from entering the second axially extending bore.

Still other objects, advantages and features of the present invention will become apparent from a consideration of the following description taken in conjunction with the accompanying drawings.

BRIEF DESCRIPTION OF THE DRAWINGS In The Drawings.

DETAILED DESCRIPTION OF THE PREFERRED EMBODIMENT

Figure 1:
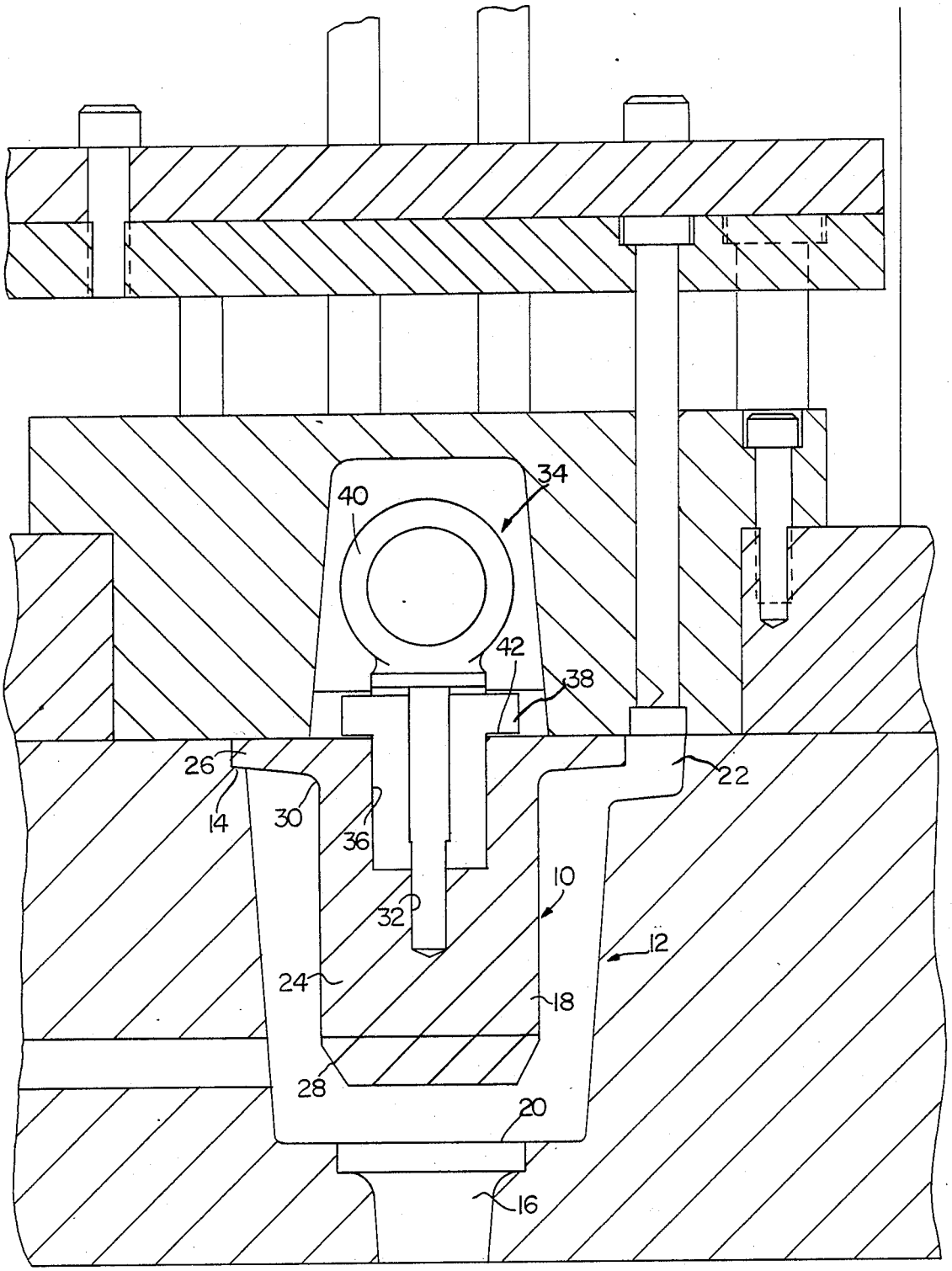
FIG. 1 is a cross-sectional view of an arrangement for practicing the method of making a bearing in accordance with the present invention.

Referring to the drawings, and first to FIG. 1, a method of making a bearing composed of a bronze preform having aluminum or aluminum alloy cast thereabout in accordance with the invention can be understood. The method includes the step of placing the bronze preform 10 (see also FIG. 2) in a mold 12 so as to be supported at one end 14 thereof. The bronze preform 10 is formed of a bronze having lead with a determined melting point and boiling point. The method also includes the step of providing molten aluminum or aluminum alloy as at 16 to be fed into the mold 12 after the bronze preform 10 has been placed therein. The molten aluminum or aluminum alloy as at 16 is at a temperature between the melting point and boiling point of lead in the bronze of the bronze preform 10. The method further includes the step of feeding the molten aluminum or aluminum alloy as at 16 into the mold 12 under pressure after the bronze preform 10 has been placed therein. The molten aluminum or aluminum alloy as at 16 contacts the bronze preform 10 and produces a molten lead during partial erosion of the surface 18 thereof. With this arrangement, the molten aluminum or aluminum alloy as at 16 forces the molten lead away from the surface 18 of the bronze preform 10 an is metallurgically bonded without an intervening lead band directly to the bronze preform 10.

Still referring to FIG. 1, the molten aluminum or aluminum alloy as at 16 is forced into the mold 12 at the end 20 thereof opposite the end 14 where the bronze preform 10 is supported after placement therein. The bronze preform 10 is supported in the mold 12 at the top thereof and the molten aluminum or aluminum alloy as at 16 is fed into the mold 12 at the bottom thereof in the preferred embodiment. Moreover, the mold 12 preferably includes at least one catch basin 22 adapted to receive the molten lead forced away from the surface 18 of the bronze preform 10 by the molten aluminum or aluminum alloy as at 16.

Advantageously, the mold 12 includes a plurality of circumferentially spaced catch basins such as 22 disposed about the top 14 of the mold 12 in spaced relation to the surface 18 of the bronze preform 10. Furthermore, in some applications it may be desirable for the bronze preform 10 to be pre-immersed and agitated in a bath of the molten aluminum or aluminum alloy (not specifically shown) prior to being placed in the mold 12 to produce and force the molten lead away from the surface 18 thereof. In this case, the bronze preform 10 is preferably pre-immersed and agitated in the bath for at least approximately ten seconds and is thereafter removed from the bath and placed in the mold 12 in no more than approximately fifteen seconds.

In any event, the bronze advantageously has a lead content of over fifteen percent, the lead has a melting point of approximately 621° F., and the molten aluminum or aluminum alloy in the bath and/or the mold is at a temperature of approximately 1400° F.

Figure 2:
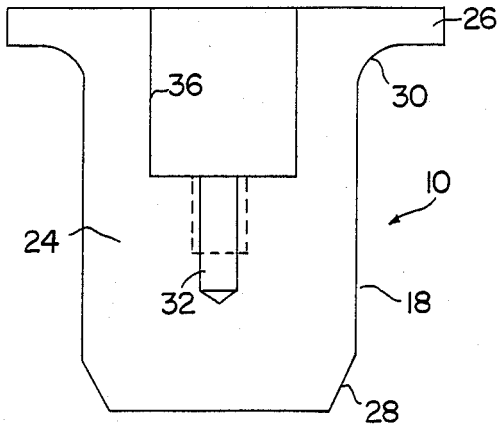
FIG. 2 is a cross-sectional view of an insert for the bearing.

As best shown in FIG. 2, the bronze preform 10 comprises a generally cylindrical body portion 24 having a radially extending rim or flange 26 at one end thereof adapted to cooperate with the top 14 of the mold 12 for supporting the bronze preform 10 therein. It will also be seen and appreciated that the bronze preform 10 preferably has a circumferentially chamfered edge as at 28 at the other end thereof, i.e., the end opposite the rim or flange 26, which is adapted to be disposed in spaced confronting relation to the bottom 20 of the mold 12 (see FIG. 1). Also, as clearly shown in FIG. 2, the bronze insert 10 preferably includes an area of radial transition as at 30 to facilitate the bonding of aluminum to bronze.

Referring to both FIG. 1 and FIG. 2, the bronze preform 10 includes an axially extending threaded bore 32 in the one end thereof, i.e., the end having the rim or flange 26, which is adapted to releasably receive an insert handling fixture generally designated 34. The bronze preform 10 includes a second axially extending bore 36 in the one end thereof which is shallower but of greater diameter than the threaded bore 32. Preferably, the insert handling fixture 34 includes a plate 38 which cooperates with the radially extending rim 26 and a lifting ring 40 which cooperates with the threaded bore 32 and seal means such as gasket 42 is disposed about the second axially extending bore 36 between the fixture 34 and the bronze insert 10.

With the present invention, there is no lead outgassing because of the temperatures utilized. For instance, with the molten aluminum or aluminum alloy being at a temperature of approximately 1400° F., this is well below the boiling point of lead which is approximately 2950° F. while above the melting point of lead of approximately 621° F. As a result, while the molten aluminum or aluminum alloy does produce molten lead, molten lead is accumulated in the catch basins, and there is no lead outgassing.

As will be appreciated, the molten lead is forced to the catch basins by the pressure of the molten aluminum or aluminum alloy. The molten aluminum or aluminum alloy is fed into the mold from the bottom under pressure to force the molten lead from the bottom to the top of the mold into the catch basins located in circumferentially spaced relation thereabout. Accordingly, the method of making a bearing is performed by utilizing a low pressure permanent mold process.

As for pre-immersion and agitation, this step is optional but can be desirable. It can be performed, for instance, by placing the bronze insert on a conventional crank arm operating at 45 R.P.M. for ten to twelve seconds in which case the bronze insert will go through several rotations within the bath of molten aluminum or aluminum alloy resulting in not only pre-immersion but also agitation. By reason of the agitation, the molten lead is moved away from the critical surface of the bronze insert.

After removal from the pre-immersion bath, the bronze insert is preferably placed in position in the mold in no more than twelve seconds. It is believed that the outside time limit is approximately fifteen seconds but, in any event, the bronze insert should be moved into the mold quickly in order to avoid oxidation on the aluminum coating that results from the pre-immersion and agitation step. After the placement in the mold, the casting process as previously described is precisely followed.

With regard to the chamfered end of the bronze insert, this is provided to help the molten aluminum or aluminum alloy flow into and about the insert. It also keeps the molten aluminum or aluminum alloy from eating away at the end of the bronze insert to an unacceptable degree. Furthermore, the transition radius at the juncture of the rim and body is provided to facilitate the flow of the molten aluminum or aluminum alloy about the bronze insert.

Preferably, the bronze insert is precleaned to remove oxides from the surface thereof. This can be done by using an aluminum oxide grit blast, or other conventional methods. In any event, this enhances the overall effectiveness of the present invention.

As for the gasket between the bronze insert and fixture plate, this is preferably formed of a refractory material. The gasket along with the insert handling fixture prevents molten aluminum or aluminum alloy from flowing into the bore or bores in the one end of the bronze insert. Furthermore, the surface facing the fixture plate is preferably protected by a sodium silicate compound.

In the preferred embodiment, the bronze has a lead content of over fifteen percent. The invention has been found to be extremely well suited for bronze having a lead content of nominally twenty percent and nominally thirty percent. Of course, the invention is therefore well suited for making bearings of high lead content.

Figure 3:
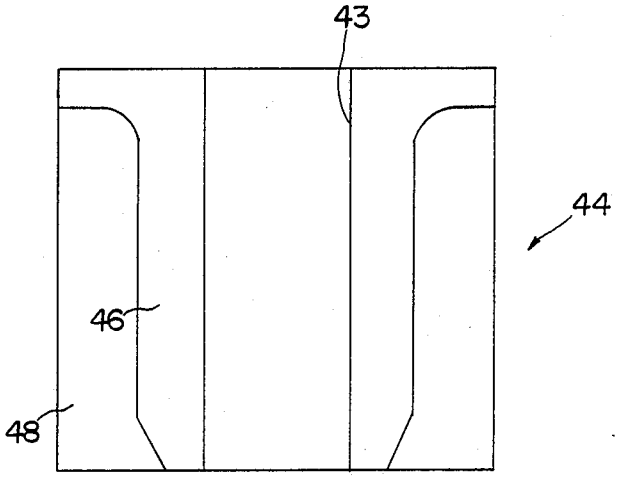
FIG. 3 is a cross-sectional view of a bearing that has been made by the method of the present invention.

As will be appreciated, the invention is well suited for manufacturing aircraft bearings because of the high lead content capabilities. It will be appreciated that a bearing having a high lead content is particularly well suited for such applications because of the lubricity of lead which provides support, when the fluid film is inadequate, to a shaft inserted into a bore 43 in the finished bearing 44 (see FIG. 3) wherein the bearing 44 comprises an inner portion 46 consisting of the remainder of the bronze insert 10 and an outer portion 48 consisting of the aluminum or aluminum alloy which has metallurgically bonded to the bronze insert 10. With this arrangement, the bearing has excellent heat transfer characteristics and is self healing in the event that it is scored.

While in the foregoing there have been set forth preferred embodiments of the invention, it is to be understood that the invention is only to be limited by the spirit and the scope of the appended claims.

I claim:

1. A method of making a bearing composed of a bronze preform having aluminum or aluminum alloy cast thereabout, comprising the steps of:

placing said bronze preform in a mold so as to be supported at one end thereof, said bronze preform being formed of a bronze having lead with a predetermined melting point and boiling point;

providing molten aluminum or aluminum alloy to be fed into said mold after said beonze preform had been placed therein, said molten aluminum or aluminum alloy being at a temperature between said melting point and boiling point of lead in said bronze of said bronze preform; and feeding said molten aluminum or aluminum alloy into said mold under pressure after said bronze preform has been placed therein, said molten aluminum or aluminum alloy contacting said bronze preform and producing a molten lead during partial erosion of the surface thereof;

said molten aluminum or aluminum alloy forcing said molten lead away from the surface of said bronze preform, said molten aluminum or aluminum alloy being metallurgically bonded without an intervening lead band directly to said bronze preform.

2. The method of making a bearing as defined by claim 1 wherein said molten aluminum or aluminum alloy is forced into said mold at the end opposite the end where said bronze preform is supported after placement therein.

3. The method of making a bearing as defined by claim 1 wherein said bronze preform is supported in said mold at the top thereof and said molten aluminum or aluminum alloy is fed into said mold at the bottm thereof.

4. The method of making a bearing as defined by claim 1 wherein said mold includes at least one catch basin adapted to receive said molten lead forced away from the surface or said bronze preform by said molten aluminum or aluminum alloy.

5. The method of making a bearing as defined by claim 4 wherein said bronze preform is supported in said mold at the top thereof and said molten aluminum or aluminum alloy is fed into said mold at the bottom thereof.

6. The method of making a bearing as defined by claim 5 wherein said mold includes a plurality of circumferentially spaced catch basins disposed about the top of said mold in spaced relation to the surface of said bronze preform.

7. The method of making a bearing as defined by claim 1 wherein said bronze preform is pre-immersed and agitated in a bath of said molten aluminum or aluminum alloy prior to being placed in said mold to initiate alloying of the aluminum and the copper and to force said molten lead away from the surface thereof.

8. The method of making a bearing as defined by claim 1 wherein said bronze has a lead content of over 15%, said lead has a melting point of approximately 621° F., and said molten aluminum or aluminum alloy is at a temperature of approximately 1400° F.

9. A method of making a bearing composed of a bronze preform having aluminum or aluminum alloy cast thereabout, comprising the steps of:

placing said bronze preform in a mold so as to be supported at one end thereof, said bronze preform being formed of a bronze having lead with a predetermined melting point and boiling point, said bronze preform being supported in said mold at the top thereof;

providing molten aluminum or aluminum alloy to be fed into said mold after said bronze preform has been placed therein, said molten aluminum or aluminum alloy being at a temperature between said melting point and boiling point of lead in said bronze of said bronze preform; and feeding said molten aluminum or aluminum alloy into said mold under pressure after said bronze preform has been placed therein, said molten aluminum or aluminum alloy contacting said bronze preform and producing a molten lead during partial erosion of the surface thereof, said molten aluminum or aluminum alloy being fed into said mold at the bottom thereof;

said molten aluminum or aluminum alloy forcing said molten lead away from the surface of said bronze preform, said molten aluminum or aluminum alloy being metallurgically bonded without an intervening lead band directly to said bronze preform, said mold including at least one catch basin adapted to receive said molten lead therein.

10. The method of making a bearing as defined by claim 9 wherein said mold includes a plurality of circumferentially spaced catch basins disposed about the top of said mold in spaced relation to the surface of said bronze preform.

11. The method of making a bearing as defined by claim 10 wherein said bronze preform is pre-immersed and agitated in a bath of said molten aluminum or aluminum alloy prior to being placed in said mold to initiate alloying of the aluminum and the copper and to force said molten lead away from the surface thereof.

12. The method of making a bearing as defined by claim 11 wherein said bronze preform is pre-immersed and agitated in said bath for at least approximately ten seconds and is thereafter removed from said bath and placed in said mold in no more that approximately fifteen seconds.

13. The method of making a bearing as defined by claim 9 wherein said bronze preform comprises a generally cylindrical body portion having a radially extending rim at one end thereof adapted to cooperate with the top of said mold for supporting said bronze preform therein.

14. The method of making a bearing as defined by claim 9 wherein said bronze preform comprises a generally cylindrical body portion having a circumferentially chamfered edge at one end thereof adapted to be disposed in spaced confronting relation to the bottom of said mold.

15. The method of making a bearing as defined by claim 13 wherein said bronze preform includes an axially extending threaded bore in said one end thereof, said axially extending threaded bore being adapted to releasably receive an insert handling fixture.

16. The method of making a bearing as defined by claim 15 wherein said bronze preform includes a second axially extending bore in said one end thereof, said second axially extending bore being shallower but of greater diameter than said threaded bore.

17. The method of making a bearing as defined by claim 16 including seal means disposed about said second axially extending bore between said fixture and said bronze insert, said fixture including a plate cooperating with said radially extending rim and a lifting ring cooperating with said threaded bore.

18. A method of making a bearing composed of a bronze preform having aluminum or aluminum alloy cast thereabout, comprising the steps of:

placing said bronze preform in a mold so as to be supported at one end thereof, said bronze preform being formed of a bronze having lead with a predetermined melting point and boiling point, said bronze preform being supported in said mold at the top thereof;

providing molten aluminum or aluminum alloy to be fed into said mold after said bronze preform has been placed therein, said molten aluminum or aluminum alloy being at a temperature between said melting point and boiling point of lead in said bronze of said bronze preform; and feeding said molten aluminum or aluminum alloy into said mold under pressure after said bronze preform has been placed therein, said molten aluminum or aluminum alloy contacting said partial erosion of the surface thereof, said molten aluminum or aluminum alloy being fed into said mold at the bottom thereof;

said bronze preform comprising a generally cylindrical body portion having a radially extending rim at one end thereof adapted to cooperate with the top of said mold for supporting said bronze preform therein and also having a circumferentially chamfered edge at the other end thereof adapted to be disposed in spaced confronting relation to the bottom of said mold;

said molten aluminum or aluminum alloy forcing said molten lead away from the surface of said bronze preform, said molten aluminum or aluminum alloy being metallurgically bonded without an intervening lead band directly to said bronze preform, said mold including at least one catch basin adapted to receive said molten lead therein.

19. The method of making a bearing as defined by claim 18 wherein said mold includes a plurality of circumferentially spaced catch basins disposed about the top of said mold in spaced relation to the surface of said bronze preform.

20. The method of making a bearing as defined by claim 19 wherein said bronze has a lead content of over 15%, said lead has a melting point of approximately 621° F., and said molten aluminum or aluminum alloy is at a temperature of approximately 1400° F.

21. The method of making a bearing as defined by claim 20 wherein said bronze preform includes an axially extending threaded bore in said one end thereof, said axially extending threaded bore being adapted to releasably receive an insert handling fixture.

22. The method of making a bearing as defined by claim 21 wherein said bronze includes a second axially extending bore in said one end thereof, said second axially extending bore being shallower but of greater diameter than said threaded bore.

23. The method of making a bearing as defined by claim 22 including seal means disposed about said second axially extending bore between said fixture and said bronze insert, said fixture including a plate cooperating with said radially extending rim and a lifting ring cooperating with said threaded bore.

24. The method of making a bearing as defined by claim 23 wherein said bronze preform is pre-immersed and agitated in a bath of said molten aluminum or aluminum alloy for at least approximately ten seconds, said pre-immersion and agitation being performed prior to said bronze preform being placed in said mold to initiate alloying of the aluminum and the copper and to force said molten lead away from the surface thereof, said bronze preform thereafter being removed from said bath and placed in said mold in no more than approximately fifteen seconds.

25. The method of making a bearing as defined by claim 24 wherein said bronze insert is precleaned to remove oxides from the surface thereof.

* * * * *